US009736591B2

(12) United States Patent
van Halteren et al.

(10) Patent No.: US 9,736,591 B2
(45) Date of Patent: Aug. 15, 2017

(54) LOUDSPEAKER, AN ARMATURE AND A METHOD

(71) Applicant: Sonion Nederland B.V., Hoofddorp (NL)

(72) Inventors: Aart Zeger van Halteren, Hobrede (NL); Adrianus Maria Lafort, Delft (NL); Caspar Titus Bolsman, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 86 days.

(21) Appl. No.: 14/632,121

(22) Filed: Feb. 26, 2015

(65) Prior Publication Data

US 2015/0245141 A1 Aug. 27, 2015

(30) Foreign Application Priority Data

Feb. 26, 2014 (EP) ..... 14156692

(51) Int. Cl.
*H04R 11/02* (2006.01)
*H04R 7/02* (2006.01)
*H04R 1/00* (2006.01)

(52) U.S. Cl.
CPC ..... *H04R 7/02* (2013.01); *H04R 1/00* (2013.01); *H04R 11/02* (2013.01)

(58) Field of Classification Search
CPC ..... H04R 11/02
USPC ..... 381/417, 418
See application file for complete search history.

(56) References Cited

U.S. PATENT DOCUMENTS 1,559,158 A * 10/1925 Butcher ..... H04R 11/02 381/418
3,062,926 A * 11/1962 Ronci ..... H04R 11/00 318/119
3,313,892 A * 4/1967 Cross ..... H04R 11/00 381/418

(Continued)

FOREIGN PATENT DOCUMENTS

JP 2013 138292 A 7/2013
WO WO 2007/140403 A2 12/2007

OTHER PUBLICATIONS

Extended European Search Report corresponding to co-pending European Patent Application Serial No. EP 14156692.7, European Patent Office, dated Nov. 11, 2014; (5 pages).

*Primary Examiner* — Davetta W Goins
*Assistant Examiner* — Jasmine Pritchard
(74) *Attorney, Agent, or Firm* — Nixon Peabody LLP

(57) ABSTRACT

A loudspeaker having a first magnet configured to output a first magnetic field in a first magnet gap, an elongate armature extending through the first magnet gap, a first coil configured to generate a magnetic flux in the armature, a first diaphragm, a first element configured to transfer force and/or movement from the armature to the first diaphragm, a base and a first and a second support element, the first support element connecting the armature to the base at a first longitudinal position at a first side of a predetermined portion along the length of the armature, and the second support element connecting the armature to the base at a second longitudinal position at a second, opposite side of the predetermined portion. The base may flex between a U-shape and an inverted U-shape and may thus provide force to move the diaphragm.

15 Claims, 8 Drawing Sheets

(56) References Cited

U.S. PATENT DOCUMENTS 5,216,723 A * 6/1993 Froeschle ..... H04R 9/025 381/415
5,299,176 A * 3/1994 Tibbetts ..... H04R 11/00 367/175
6,285,773 B1 * 9/2001 Carme ..... H04R 9/06 181/150
6,389,145 B2 * 5/2002 Baumhauer, Jr. .... H04R 1/2842 379/432
6,788,796 B1 9/2004 Miles et al.
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Halteren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosch et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,027,492 B2 * 9/2011 Miller ..... H04R 11/02 381/177
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 * 7/2012 Beekman ..... H04R 11/02 381/152
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
8,948,440 B2 * 2/2015 Lin ..... H04R 1/02 381/412
9,301,054 B2 * 3/2016 Iwakura ..... H02K 35/06
2005/0031152 A1 * 2/2005 Hansen ..... H04R 7/12 381/410
2005/0152574 A1 * 7/2005 Van Banning ..... H04R 11/02 381/417
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.

* cited by examiner

LOUDSPEAKER, AN ARMATURE AND A METHOD

CROSS-REFERENCE TO RELATED APPLICATION

This application claims the benefit of European Patent Application Serial No. EP14156692.7, filed Feb. 26, 2014, and titled "A Loudspeaker, An Armature And A Method," which is incorporated herein by reference in its entirety.

FIELD OF THE INVENTION

The present invention relates generally to loudspeakers, and more particularly to a loudspeaker having an armature attached to the base or housing at two positions so that it, when bending, obtains a U-shape.

SUMMARY

The present invention relates to a new type of loudspeaker having an armature attached to the base or housing at two positions so that it, when bending, obtains a U-shape. This has a number of advantages both in relation to vibration reduction and in that multiple drive pins may be used for the same diaphragm, obtaining a so-called piston movement of the diaphragm. Technology of this type may be seen in: JP2013/138292 and WO2007/140403.

The most usual approach for vibration reduction is to use dual receivers. This has the following disadvantages:

1. Cost;
2. For maximum vibration performance, matching is needed;
3. This principle only works for translations perpendicular to the diaphragm, whereby this solution is not available for higher frequencies and in most constructions;
4. Since single receivers use the volume more efficiently, a dual receiver has a lower efficiency and a lower output for the same size.

To reduce the vibration in a single receiver, it is required to develop a force in the opposite direction of movement of the diaphragm. Different manners have been tested, such as using a seesaw construction or using the magnet stack as a counterweight.

One of the general problems is that in the real world, the conditions change due to acoustic loads changing. Also, some of the other trade-offs are additional complexity and an increase in size, especially with the less 'principal balanced' constructions (using different parts with different weights or complex transmission mechanisms to balance vibration).

Another problem of current receivers is seen when the diaphragms are hinged at one side, whereby the maximum output is half compared to a membrane that is moving like a piston driving in the middle with the same amplitude.

In a first aspect, the invention relates to a loudspeaker comprising:

a first magnet configured to output a first magnetic field in a first magnet gap, an elongate armature extending through the first magnet gap, a first coil configured to generate a magnetic flux in the armature, a first diaphragm, a first element configured to transfer force and/or movement from the armature to the first diaphragm, a base and a first and a second support elements, the first support element connecting the armature to the base at a first longitudinal position at a first side of a predetermined portion along the length of the armature, and the second support element connecting the armature to the base at a second longitudinal position at a second, opposite side of the predetermined portion.

In the present context, a loudspeaker typically is a device able to, adapted to and/or configured to receive a signal, such as an electrical, optical and/or acoustical signal and convert this signal into sound. The signal may be converted and/or adapted, such as converted from one electrical standard to another, converted from an optical to an electrical signal, converted from a digital signal to an analogue signal, filtered, amplified, or the like, before conversion into sound.

The sound generation may be obtained by vibration or movement of the diaphragm. A usual type of driver for loudspeakers is a moving armature set-up where an armature extends within a magnetic field while carrying a magnetic flux, causing the armature to move along the direction of the magnetic field. This moving armature then is coupled to the diaphragm to transfer movement/force/torque to the diaphragm.

In this context, a magnet may be a single element or a number of elements, such as a magnet stack. The magnet may comprise a yoke if desired in order to define or create the magnet gap. The magnet gap is an area or volume in which a magnetic field created by the magnet exists.

In a preferred embodiment, the magnet defines a magnetic gap in which at least a large part of the magnetic field lines are substantially parallel and straight, so that the force acting on the armature therein is a along a well-defined direction. This may be obtained by providing a C-shaped magnet, such as a magnet with a yoke or by providing two magnets, polarized in the same direction, defining there between the magnet gap, for example.

An armature may be any type of material, element and/or assembly able to guide or carry a magnetic flux. The armature may be electrically conducting or not. Preferably, the armature is a monolithic element, especially due to the fact that the present loudspeaker may be desired very small, whereby assemblies of this size may be difficult to provide. The present loudspeaker may be a so-called miniature loudspeaker which may have a volume, including a housing thereon, of no more than 100 $mm^3$, such as no more than 75 $mm^3$, such as no more than 50 $mm^3$, such as no more than 40 $mm^3$, such as no more than 30 $mm^3$, such as no more than 20 $mm^3$.

The armature is longitudinal, which preferably is an element having a longest dimension and a width perpendicular to the longest dimension, where the longest dimension is 2 times or more, such as 4 times or more, preferably 6 times or more, such as 10 times or more, preferably 15 times or more, such as 20 times or more, or 30 times or more times the width thereof. As will be described further below, the armature may be formed of a main, elongate element and have protruding parts extending therefrom. In this situation, the width will be that of the main, elongate elements.

The armature is preferably bendable. The stiffness of the armature, the skilled person will know, will be selected in accordance with the dimensions of the remaining parts of the loudspeaker, the force required to move the diaphragm in the desired manner, the weight of the remaining elements and the like.

In a miniature loudspeaker, the armature may be made of 50-50 NiFe and have dimensions of 1.5 mm wide and 0.15 mm thick. The stiffness of the armature may be 2000-3000 N/m.

Preferably, the armature is straight, when projected on to a plane of the diaphragm, so that a bending thereof causes forces along a predetermined direction. Bending of a bent or curved armature may cause rotation and more complex vibration scenarios, which may, naturally, be compensated for and determined, but which are nevertheless more complex.

The coil may be any type of coil and is, as is usual for coils, configured to generate a magnetic flux or magnetic signal. Usually, this flux or signal is caused by an electrical current guided in the coil, and the overall goal of loudspeakers usually is to output sound corresponding, such as in intensity and/or frequency contents, to that of a signal received.

The coil is configured to generate the magnetic flux in the armature. This may be obtained by the armature extending through the coil or by the armature receiving the flux from the coil, such as from an element extending through the coil.

The diaphragm is an element, typically a flat element and/or a relatively stiff element which, when moved, typically in a direction perpendicular to a general plane of the diaphragm causes air or gas to move or vibrate, whereby sound may be produced. Often, the diaphragm and other elements of the loudspeaker are provided in a housing, the inner space of which is divided into two chambers by the diaphragm. The vibration of the diaphragm will cause volume changes of the chambers inducing air pressure changes and thus, when a sound output is provided, sound output of the output.

The diaphragm may have dimensions of 8*3 $mm^2$. and may have a thickness of typically 50 μm. A diaphragm may be made of e.g. nickel or aluminum.

In order to increase a stiffness of the diaphragm, it may be provided as a laminate of layers and/or the diaphragm may be corrugated or provided with a shape deviating from a flat shape.

The first element preferably is oblong, stiff and light. The first element may be connected to the armature at one end and the diaphragm at the other end. Preferably, the first element extends along a direction of the force exerted by the armature to the diaphragm. The first element may have dimensions as known to a person skilled in the art of balanced armature design.

The base may form part of a housing wherein the diaphragm, magnet, armature, coil etc. may be positioned. Alternatively, the base may be formed by any type of material, monolithic as well as an assembly, such as a laminate. Preferably, the base is stiffer than the armature so that the force exerted to the armature will not cause any significant deformation of the base.

Naturally, the coil and/or the magnet may be fixed to the base if desired, and the base, as is described further below, may form part of a flux return path of the flux generated by the coil and/or of the magnetic field generated by the magnet.

The support elements operate to connect the armature at two different longitudinal positions or portions to the base. The connection to the base via the support elements may be a fixing in relation to the base, but preferably, the connection is at least rotatable allowing the armature to rotate, at the first and second positions or portions, in relation to the support elements and/or the base.

The longitudinal positions are positions along the length of the oblong armature. The positions may be determined from e.g. an end portion of the armature, where the positions are positions between two extreme end portions of the armature.

The predetermined portion may be any portion of the armature, typically at a center or middle thereof. As mentioned further below, the predetermined portion preferably is bendable and may even be provided as a hinge portion, such as a softer, more bendable or narrower portion which bends more easily than other parts of the armature.

Preferably, the first and second positions or portions are the only portions of the armature which are not movable in relation to the base, such as movable in a direction toward or away from the base. In one embodiment, the part of the armature between the first and second positions or portions is not limited in movement toward or away from the base. Also, parts of the armature positioned between the end portions and the first/second portions/positions are preferably able to, such as configured to, move toward or away from the base.

In one embodiment, the only elements touching or engaging the armature, apart from the support elements, may be the first element and any additional elements for driving the diaphragm and optionally additional diaphragm.

As will be described further below, the loudspeaker of the invention may be vibration compensated or vibration reduced, as the mass of the armature between the two positions and that of the armature outside the two positions may be adapted to each other so that the overall vibration caused by sound generation may be reduced. This, balancing will occur also in different acoustical situations.

Additionally, shock improvement may be obtained, since the force exerted on the armature in may be evenly divided over the length of the armature.

In one embodiment, a relatively large coil is used in order to obtain a high LF efficiency.

The movement or deformation of the armature, due to the two positions or portions of engagement with the support elements and/or fixing in relation to the base, will be the armature obtaining a U-shape or a V-shape with a larger or smaller bending angle. The shape of the armature may thus, under operation, vary between an upwardly (toward the diaphragm) directed U-shape and a downwardly (away from the diaphragm) directed U-shape and/or a between a U-shape and a plane shape.

This bending may be possible using the two support elements. These elements may, naturally, be positioned sufficiently spaced to allow the predetermined portion to be moved in a direction toward or away from the diaphragm. Preferably, portions of the armature on the outer sides of the support elements are also allowed to or configured to move in a direction toward or away from the diaphragm. Due to the positions of the support elements, the predetermined portion will move toward the diaphragm when the outer portions move away from the diaphragm. Thus, vibration reduction may be obtained. This is described further below.

In this respect, the positions of the support elements may be selected within wide ranges. Preferably the portion there between is able to move toward and away from the diaphragm, as may at least one portion of the armature outside a support element be desired to. The distance, when projected on to a longitudinal axis of the armature or where fixed to the armature, of the first and second support elements may be any percentage, such as 5-100%, such as 5-90%, 10-80%, 10-90%, 20-70%, 20-80%, 30-50%, 30-60%, 30-70%, 30-80%, 40-60%, 40-70%, 40-80% and/or 40-90% of a length of the armature, such as a length between two end portions of the armature.

The positions may be determined from an end portion of the armature, and at least one of the support elements may be positioned, within a distance, relative to the length of the armature, of 0-50%, such as 0-10%, 0-20%, 0-30%, 0-40%, 10-20%, 10-30%, 10-40%, 10-50%, 10-40%, 20-30%, 20-40%, 20-50%, 30-40%, 30-50% and/or 40-50%, for example, where the other support element is positioned closer to the other end of the armature. One of the support elements may be positioned, within a distance, relative to the length of the armature, of 30-80%, such as 30-90%, 40-70%, 40-80%, 40-90%, 50-70%, 50-80%, 50-90%, 60-70%, 60-80%, 60-90%, 70-80%, 70-90%, and/or 80-90%, where the other support element is positioned closer to the other end of the armature.

In one situation, the armature is configured to be movable in a direction toward or away from the diaphragm within the first magnet gap. When the portion of the armature extending within the magnet gap carries a flux, the magnet field in the magnet gap will cause the armature to move toward/away from the diaphragm and thereby cause deformation or movement of the armature.

The movement or deformation of the armature may be facilitated in a number of manners. In one situation, at least one of the first and second support elements is configured to resiliently or rotatingly fix the armature to the base at the first and second longitudinal positions. In this situation, the movement of e.g. the predetermined portion toward the diaphragm will cause the extreme portions of the armature to move away from the diaphragm, as the armature may rotate in relation to the support elements. Thus, the stiffness of the armature is greater than the rotation resistance caused by the supporting elements, whereby the downward movement of the armature at one side of a support element will cause the armature on the other side of the support element to move upwardly. The vibration resembles a lowest order bending mode of a beam with two nodes.

This rotational capability may be obtained in a number of manners, such as by providing the support element as a supporting element and an interface element such as a glue, rubber, foam, metal between the stiffer supporting element and the armature. Preferably, the armature, at the first and/or second positions, is able to rotate at least (between the two extreme angular positions) 1-2 degrees.

It is noted that the Euclidian distance between the first and second positions will change, when the armature changes shape. This minor distance change also preferably is allowed by the support elements in order to not inhibit the armature shape change.

Also, preferably, the support elements, under normal operation, prevent the first/second positions of the armature from moving more than 1-2% of the length of the first/second support element (shortest distance from base to the first/second position) or the first/additional element (shortest distance from diaphragm to first/second position), so that rotation may be allowed, but preferably no translation of the armature toward/away from the base to any significant degree.

An alternative to the above interface element is to provide the first and/or second support element as a bendable element. Then, the deformation or shape change of the armature may be allowed by the support elements deforming (bending). This bending may be a bending of all of the support element or a part thereof. The support element may be made of an element configured to bend more or less equally along its length, such as a rod having the same cross section along its length, or the support element may be configured or provided with a bending or hinge part at which the bending/rotation takes place. A combination of course is possible, as is a combination of a bendable/rotatable support element with an interface element.

In one embodiment, the armature extends within the first coil and is configured to be movable in a direction toward or away from the diaphragm within the first coil. Thus, the movement of the armature is independent of the coil.

In another situation, the armature extends within the first coil and is fixed to the first coil. In this situation, the coil will also be able to feed a flux into the armature, but the weight of the coil is now added to the part of the armature extending through the coil, which may be used in relation to e.g. vibration cancelling.

In a particularly interesting embodiment, the loudspeaker comprises an additional element configured to transfer force and/or movement from the armature to the first diaphragm, the first and additional elements both being positioned either between the first and second support elements or outside the first and second support elements.

This embodiment has a number of advantages.

Firstly, the use of multiple elements, so-called drive pins, for driving the diaphragm may drive or move the diaphragm in a direction perpendicular to a general plane of the diaphragm (the so-called piston movement) which brings about a very efficient sound generation. In this situation, preferably the diaphragm is fixed to a housing via resilient elements allowing all of the diaphragm to move toward/away from the magnet(s).

Secondly, the driving of the diaphragm at multiple positions makes the diaphragm stiffer and thus increases sound reproduction, especially at higher frequencies.

The multiple elements may be positioned at positions of the armature which moves up/down with the same distance to have the diaphragm move equally far up/down over at least a major part of its surface.

Alternatively, the multiple elements may be positioned at positions moving up/down with different displacements/amplitudes, such as at positions generating different amounts of force/torque during deformation of the armature. This particular embodiment is described further below and is interesting when the diaphragm is provided in a housing and forms part of a surface of a chamber having a sound outlet. The counter-pressure caused by the diaphragm movement in the chamber will be larger at larger distances from the sound output, and thus further away from the sound output, a larger force/torque is desired to drive the diaphragm. Thus, the positions of the multiple elements and the amount of force/torque applied thereby may be adapted to a position of the sound output to obtain optimal sound output. In this situation, the distance may be the Euclidian distance between a point of engagement of the diaphragm and element and the output when projected on to a plane defined by the diaphragm.

In other situations, distances relating to elements attached to or relating to the armature may be seen as distances when the elements or projections are projected on to a longitudinal axis of the armature. These may be distances between points of engagement of the element with the armature or positions or parts where the armature and the element overlap, such as where the armature extends within a magnet gap or coil.

In one embodiment, the loudspeaker further comprises a second magnet configured to output a second magnetic field in a second magnet gap, the armature extending through the second magnet gap. The providing of a second magnet has a number of advantages, such as when the parts of the armature extending within the two magnet gaps both carry a flux, both these parts are caused to move and thus take part in the deforming of the armature.

In one situation, the first and second support elements are positioned symmetrically around the predetermined portion. Then, the first and second magnets are preferably positioned symmetrically around the predetermined portion. Naturally, the symmetry makes design of the loudspeaker simpler, but it is, as is described further below, by no means a requirement. A symmetric set-up may facilitate using identical magnets to obtain a symmetric deformation of the armature, for example.

In this situation, also the coil or coils used may be symmetrically positioned around the predetermined portion. Even the first and additional element (if present) may be positioned symmetrically around predetermined portion if desired.

Alternatively or additionally, the first and second magnets may both be positioned outside the first and second support elements. Alternatively, the magnets may both be provided between the first and second support elements. Then, if the flux in the parts of the armature extending within the magnet gaps has the same direction, this position of the magnets facilitates using magnets with the same magnetization direction. Otherwise, opposite magnetization directions may be used.

In this situation, and when the additional element is used for driving the diaphragm, the first and additional elements may be positioned outside the first and second magnets. In this manner, a relative large distance there between may be obtained. When both elements are positioned outside (or inside) the support elements or first/second positions, these parts are moved in the same direction (upwardly or downwardly) at the same time. The further away from the support elements, the larger the displacement of the diaphragm and elements. When positioned outside the support elements the closer to end portions of the armature, the larger the displacement. When positioned inside two support elements the closer to the centre, the larger the displacement Naturally, the first element may alternatively be positioned between the first and second support elements. In this manner, a relatively large displacement of the element and diaphragm is also possible, and multiple elements may also be used when positioned between the first/second positions.

In one embodiment, the loudspeaker comprises an additional diaphragm and a second element configured to transfer force and/or movement from the armature to the second diaphragm.

Dual diaphragm loudspeakers have the advantage of outputting a larger sound intensity but also that they may be made vibration compensated. In this situation, the diaphragms are usually parallel, where the diaphragm in one loudspeaker moves in the opposite direction of that of the other loudspeaker. Also in the present situation is it preferred that the diaphragms are parallel.

Thus, preferably, the first element is positioned between the first and second support elements and the second element is positioned outside the first and second support elements—or vice versa. Thus, the coil(s), magnet(s), armature etc. may be provided between the two diaphragms and be used for driving both diaphragms.

In one embodiment, the armature has two extreme end portions, where a mass of a part of the armature between the first and second positions is no more than 20% higher or lower than a mass of parts of the armature between the end portions and the first and second positions, respectively. In this respect, the mass, dimensions, cross section etc. of the armature, the positions of the first/second positions, as well as the maximum Euclidian distance moved during operation of each part of the armature may be taken into account in order to obtain a vibration-free or vibration-less loudspeaker.

In one embodiment, the predetermined portion extends through the first coil, which may then be positioned at the centre of the armature.

In one embodiment, the predetermined portion comprises a hinge portion, which may be a particular portion at which bending is supposed to take place, as an alternative to an armature where a larger portion, such all of the armature between the first and second positions, has the same properties (such as the same cross section) and thus is supposed to bend more or less equally.

A hinge portion may be obtained by providing the portion with a higher flexibility, a lower cross-section, a lower stiffness, a hinge, or the like. This portion may be made of another material than other parts of the armature if desired.

The providing of a hinge portion may prevent malfunctioning due to material stress and bending fatigue of the armature, if a portion configured to bend or rotate is provided.

In one situation, the loudspeaker comprises at least one additional coil, such as a coil configured to emit a second electromagnetic field into the armature. This additional coil may output a field or flux into the armature along the same direction, or opposite thereto, of the field/flux received in the armature from the first coil.

The first coil may provide a flux to a portion of the armature extending through the first magnet gap, and the additional coil may provide a flux into a portion of the armature extending through the second magnet if provided. In this manner, two sets of coil/magnet may be selected and positioned more independently of each other and, for example, the direction of the field and magnetization may be independently chosen.

As mentioned above, advantages are seen in the symmetric situation, thus, the first and additional coils are preferably positioned symmetrically around the predetermined portion. It is noted that in the situation where the armature does not extend through one or both of the coils, the position at which the armature receives the flux(es)/field(s) may be positioned symmetrically.

In one embodiment, the loudspeaker further comprises a first magnetically permeable element forming part of a first closed flux path extending through the first coil and comprising a first portion of the armature extending through the first magnet gap. As mentioned above, when the flux generated by the coil enters the armature part in the magnet gap, this part of the armature will be forced in the direction of the magnetic field. Having exited this part of the armature, the flux lines must revert to the coil and preferably with as little attenuation as possible. This flux path may be partly formed by this first magnetically permeable element. Also other elements of the loudspeaker, such as magnets, a magnet yoke, if used, the base, a housing or the like may take part in this flux path.

The magnetically permeable element may be made of any magnetically permeable material, such as 50-50 NiFe.

In this situation, the magnetically permeable element may be elongate, separate from the armature and extend through the first coil, so that the armature does not extend through the first coil.

Also, and in the situation where the loudspeaker comprises the second magnet, the loudspeaker may further comprise a second coil and second magnetically permeable element forming part of a second closed flux path extending through the second coil and comprising a second portion of the armature extending through the second magnet gap. Thus, two separate flux paths may be obtained.

In this situation, in a plane perpendicular to a general plane of the first diaphragm and comprising a general, longitudinal axis of the armature, the first and second magnets are magnetized in at least substantially the same direction (i.e. toward or away from the diaphragm), the first coil and the first magnet being positioned on one side of the predetermined portion and the second coil and the second magnet on an opposite side of the predetermined portion. Thus, a symmetric set-up may be provided where, again, the same magnetization of the magnets may be used.

In addition, when two distinct flux paths are defined, these may be defined on either side of the predetermined portion, whereby no flux is required to flow over the predetermined portion. Then, the material properties of the predetermined portion, which may be provided as a bending or hinge portion, may be separated from the magnetic properties of the remainder of the armature.

In fact, the first and second magnetically permeable elements may simply be formed by a third magnet which, in the plane, is magnetized at least substantially in the same direction as the first and second magnets and which is positioned at the predetermined portion. This magnet may then also aid in the deformation of the armature. Then, the first coil may be positioned between the first and third magnets and the second coil between the second and third magnets. Alternatively, the flux/field from the first/second coils may be provided to the armature at those positions. Again, a symmetric set-up may be provided, and the first and second support elements may also be positioned symmetrically, such as between the coils and the first/second magnets, such as between the coils and the third magnet, or outside the first/second magnets.

Naturally, the armature may generally have any oblong shape, when projected on to a plane of the diaphragm, such as a straight or a curved (U-shaped, S-shaped or the like), but the straight shape is preferred, as this is the simplest manner to obtain e.g. a vibration damping.

In one embodiment, the armature is a flat, elongated element extending along a longitudinal axis and having a main surface defining a first plane and where the first and second support elements form integral protruding parts of the armature, the protruding parts extending away from the longitudinal axis and within the plane. This type of element is easy to manufacture and has a number of advantages.

The protruding parts may be bent to extend out of the plane of the armature, so as to extend to a base provided out of that plane, or the protruding part may extend within the plane and be supported by a base or housing intersecting the plane.

In one embodiment, each protruding part has a hinge portion or a bending portion at which bending or rotation of outer parts of the protruding parts is possible relative to the main surface or part, so that the outer part may be fixed in relation to the base, while the main surface or part deforms.

Preferably, the protruding parts are provided in pairs, one pair being positioned at the same or at least substantially the same longitudinal position of the main surface or part and forming one support element.

Preferably, the movement of the armature is in a plane perpendicular to the diaphragm, and the element(s)/drive pin(s) extend at least generally perpendicular to the diaphragm, so that the parts of the diaphragm engaged by the element(s) is/are moved perpendicularly to the diaphragm so as to not deform this.

In general, in this aspect of the invention, it is noted that the operation of the flux generated by the coil, the armature and the function of the magnet may be obtained in a number of manners. The skilled person will easily see the advantages thereof as well as the advantage of using multiple magnets, coils, elements/drive pins and/or magnetically conducting elements.

The positions and shapes/dimensions/weight of individual parts as well as other parameters thereof will determine how and which parts move and to what degree. Thus, the vibration damping or vibration parameters of the loudspeaker may be determined and affected by re-positioning one or more elements or changing parameters of the elements.

A number of parameters are of interest. The strength of the magnets determines the force exerted to the diaphragm and the degree of deflection or movement of the armature part extending therein. The direction of polarization determines the direction of movement of the armature part. The presence of multiple magnets or a yoke affects the strength of the magnetic field in the gap.

The coil parameters determine or affect the flux or field provided to the armature. Thus, the number of windings, the current supplied thereto as well as other parameters of the coil may be selected according to the functionality desired.

The armature material will determine the support thereof of the flux/field as well as the bendability thereof. The hinge portion may be provided to decouple material parameters if desired. The weight and deflection of the different parts of the armature are important parameters in the vibration cancelling of the loudspeaker.

The support elements and their bendability or connection to the armature will determine which resistance is made to the deformation of the armature.

The position(s) of the element(s) or drive pin(s) determine not only the movement/force/torque provided to the diaphragm but may also, oppositely, be taken into account when determining the vibration parameters of the armature, as the acoustic resistance will cause a resistance or dampening of the pertaining part of the armature. Also the weight of the element(s) may be taken into account in this respect.

The skilled person will identify the above and be able to deviate from the preferred symmetric embodiments and create any non-symmetric embodiment, as the above parameters depend on each other in a derivable manner. One non-symmetric embodiment would be one where one support element is positioned at or near one end of the armature, while the other support element is positioned at a distance from the other end of the armature, so that the armature has a portion between the support elements moving toward the diaphragm while that other end moves away therefrom.

Further, it is noted that more than two support elements may be used, such as three support elements. In this situation, the same type of deformation is seen: the armature will move toward the diaphragm on one side of a support element and away therefrom on the other side. Thus, multiple parts of the armature may move toward the diaphragm while multiple parts move away therefrom. In this situation, it may be desired to provide the support elements equidistantly.

A second aspect of the invention relates to a loudspeaker comprising a housing comprising a chamber, a sound output, a diaphragm forming part of an inner surface of the chamber and a motor assembly comprising an armature, a coil and a magnet as well as at least a first and a second transfer element configured to transfer movement or force from the armature to the diaphragm, where the first transfer element is positioned closer to the output than the second transfer element, the motor assembly being configured to exert a larger displacement/force/torque on the diaphragm via the second transfer element than the first transfer element.

In this respect, the housing may comprise multiple chambers, where the diaphragm forms part of an inner surface of one or more of the chambers, so that movement of the diaphragm causes the volume of the one or more chambers to vary. In a usual embodiment, the housing has an inner space divided by the diaphragm into two chambers.

The sound output usually provides a sound opening or output from the chamber and to the surroundings.

The motor assembly may be as that described further below comprising an armature, one or more coils, one or more magnets, two supporting elements and optionally one or more magnetically conducting elements.

This aspect relates to the above situation where the acoustical resistance and thus the resistance experienced by the second transfer element is larger than that experienced by the first transfer element due to the larger distance to the output. This may be counter-acted by having the motor assembly exert a larger force/torque/movement/displacement to the second transfer element.

Naturally, the motor assembly may comprise two separate, prior art motor elements each driving a transfer element, but the above motor element is preferred in that the U-shaped deformation of the armature and the possibility of providing different displacements/forces/torques by selecting different positions on the armature makes the motor assembly rather simple. Also, using a single armature and a single motor element obviates the problem of synchronization between motor elements.

As mentioned above, also different magnet strengths, for example, may be used for exerting different forces to different parts of the armature in the first aspect of the invention, so that individual designs may easily be obtained.

In order to obtain an optimal movement of the diaphragm, it may be desired that the support elements engage the diaphragm along a central line thereof, where the central line may be within a plane perpendicular to the diaphragm and also comprising the armature, such as a central axis thereof. Also or alternatively, the central line may intersect with the sound output when projected on to the plane of the diaphragm.

The difference in displacement/force/torque may depend on the difference in acoustic resistance or air resistance, which again may depend on the dimensions of the chamber/housing, the diaphragm, the output and the like.

A second/third aspect of the invention relates to a method of operating a loudspeaker according to the first aspect of the invention, the method comprising feeding power to the coil to:

1. generate a magnetic flux within the armature
2. move the armature within the first magnet gap,
3. bend the armature at the predetermined portion, and
4. transfer, via the first element, force and/or movement from the armature to the first diaphragm.

As mentioned above, step 1 may be carried out by having the armature extend through the coil or by transferring a field/flux from an element extending through the coil and to the armature. Naturally, the field output by a coil may also be intercepted by elements not extending through the coil, even though this is much less efficient.

The movement of the armature within the gap is automatically achieved when the flux from the coil is guided by a part of the armature provided in the gap, and when the resulting force is sufficiently large to bend the armature.

The bending of the armature is the above-mentioned U- or V-shaped bending where the armature is fixed, preferably rotationally or resiliently, at two positions in relation to the base, so that when outer parts of the armature are forced downwardly, the predetermined portion is moved upwardly and vice versa.

The bending of the armature may be a bending of a larger portion thereof or the bending of a predetermined portion, such as a hinge portion, if provided. Predominantly, the part of the armature between the first and second positions may bend.

When the bending is within a plane at an angle to, preferably perpendicular to, a plane of the diaphragm, the bending of the armature will force the first element and thus the diaphragm in a direction at an angle to the plane of the diaphragm and thus cause a volume change of e.g. a chamber which is at least partly delimited by the diaphragm.

In one embodiment, the loudspeaker comprises an additional element, the first and additional elements being positioned either between the first and second support elements or outside the first and second support elements and wherein step 4 comprises also the additional element transferring force and/or movement from the armature to the first diaphragm. Above, the advantages of using two drive pins are described. A particular embodiment is one wherein the two drive pins are positioned or configured to confer different forces/torques/displacements to the diaphragm.

In one embodiment, step 3 comprises the armature bending around attachments or resilient elements provided as part of the support elements or provided between the armature and the support elements.

In addition or alternatively, step 3 may comprise the first and second support elements bending to allow the armature to bend, if the attachments between the support elements and the armature do not themselves allow bending. This bending of the support elements also allows lateral movement of the first and second positions, as the Euclidian distance there between changes when the shape of the armature changes.

In one embodiment, the loudspeaker comprises an additional diaphragm and a second element, and step 4 comprises the second element transferring force and/or movement from the armature to the second diaphragm. Preferably, the first and additional diaphragms are parallel and moved in counter phase. The movements may have the same amplitude or not. This is also described further above.

BRIEF DESCRIPTION OF THE DRAWINGS

In the following, preferred embodiments will be described with reference to the drawings, wherein.

DETAILED DESCRIPTION OF THE DRAWINGS

Figure 1:
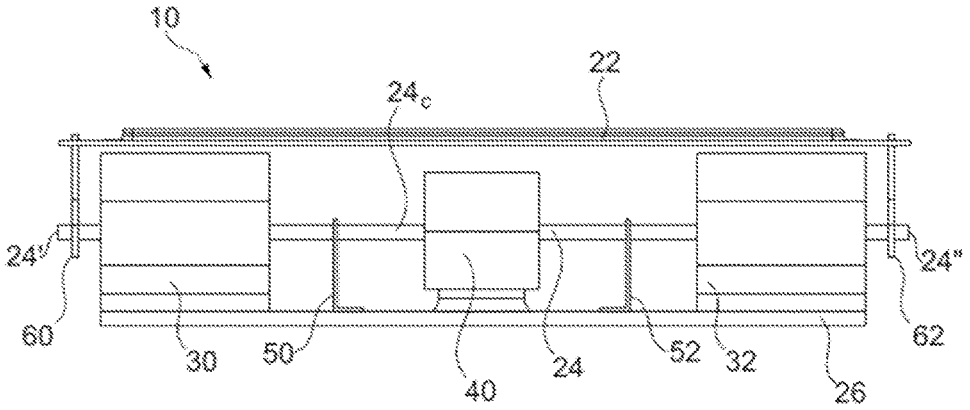
FIG. 1 illustrates main components of a first embodiment of the invention seen from the side.
Figure 2:
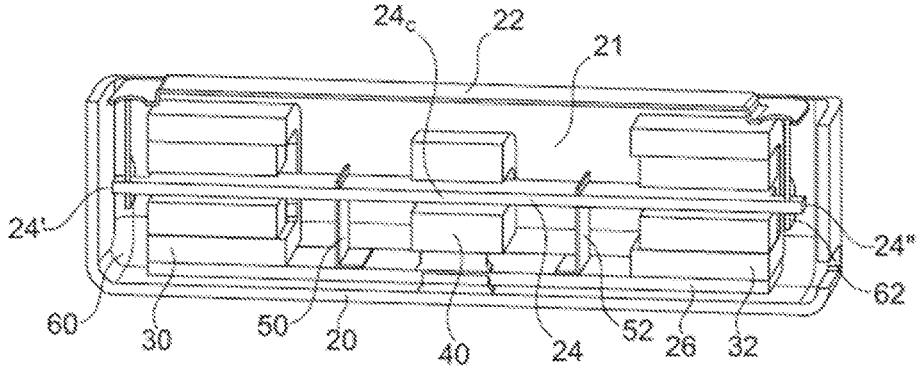
FIG. 2 illustrates a cross section of the embodiment of FIG. 1.

In FIGS. 1 and 2, a first embodiment 10 is seen. Alike elements are denoted by the same numerals.

The loudspeaker of the first embodiment 10 has a housing 20, a diaphragm 22, an armature 24, a base 26, a first magnet 30, a second magnet 32, a coil 40, a first support element or rod 50, a second support rod 52, and first and second elements 60, 62, respectively, for transferring movement/force from the armature 24 to the diaphragm 22.

The magnets 30/32 and the coil 40 are fixed to the base 26 which is fixed to the housing 20. Alternatively, the magnets 30/32 and coil 40 may be fixed directly to the housing 20 which then acts as the base 26.

The support rods 50/52 may be fixed to the base or the housing or other elements, such as the magnets, fixed to the base and/or housing.

The housing 20 may have a further part (not illustrated) positioned above the diaphragm 22 so as to provide a front chamber as is well known within loudspeaker technology.

Preferably, the chamber 21 defined by the housing 20 and diaphragm 22 may be completely sealed by the diaphragm 22 or an element (not illustrated) provided between the diaphragm 22 and housing 20, so as to ensure that sound arriving at the upper side of the diaphragm 22 is not allowed to travel into the chamber 21 between the housing 20 and the diaphragm 22.

The armature is fixed to or controlled by the first and second elements 50/52 in relation to the base 26 but all other parts are allowed to move upwardly/downwardly in relation to the base 26. Thus, the ends 24' and 24" as well as the centre portion 24*c* of the armature positioned to the left of the first element 60, to the right of element 62 and between the elements 60/62, respectively, are not fixed in relation to the base 26.

The operation of the loudspeaker of FIGS. 1 and 2 is as follows: when an electrical current is fed into coil 40, a magnetic flux is generated in the armature extending through the coil. A part of this flux will travel along a path defined by the armature 24, the base 26 and the magnets 30/32 and thus into the magnets 30/32, whereby the parts of the armature extending through the magnets will be brought to move up/down, depending on the magnetization direction of the magnets and the direction of the flux.

Preferably, the magnetization directions of the magnets is selected so that both ends 24' and 24" will move up or down at the same time, so that the diaphragm is moved upwardly or downwardly—whereby sound is produced. This provides a piston-like movement of the diaphragm, which is a highly sought-for movement providing a more efficient sound production. In this situation, the fixing of the diaphragm to the housing should be sufficiently resilient all around the diaphragm to allow this piston-like movement.

Naturally, the first and second elements 60/62 may be replaced by a single element, as will be described below. The use of multiple elements provides multiple points of driving of the diaphragm 22 and thus usually a better sound generation due to the more piston-like movement.

In reaction to the upward/downward movement of the ends 24' and 24", the centre portion 24*c* will move in the opposite direction. Thus, the portion 24*c* will move upwardly/downwardly within the coil 40. Also, this will cause a bending of the armature in the centre portion 24*c*. As will be described further below, a hinge portion may be provided in the centre portion 24*c* so as to have a well defined position of this bending.

A wide variety of set-ups utilizing this overall structure may be contemplated.

Figure 3:
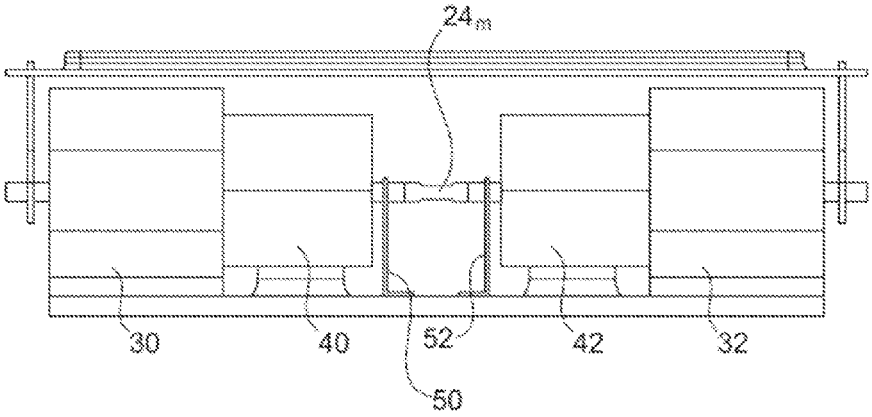
FIG. 3 illustrates a second embodiment.

In FIG. 3, two coils 40 and 42 are provided, compared to FIGS. 1 and 2. In addition, the support elements 50 and 52 have been moved closer to keep the overall dimensions of the loudspeaker small. Then, it is clear that the bending of the armature 24, between the support elements 50/52, may be quite large, whereby it may be desired to provide, between the support elements 50/52, a hinge portion 24*n* which may be a narrowing portion, a resilient portion or the like, which facilitates the bending without permanent damage to the armature.

Figure 4:
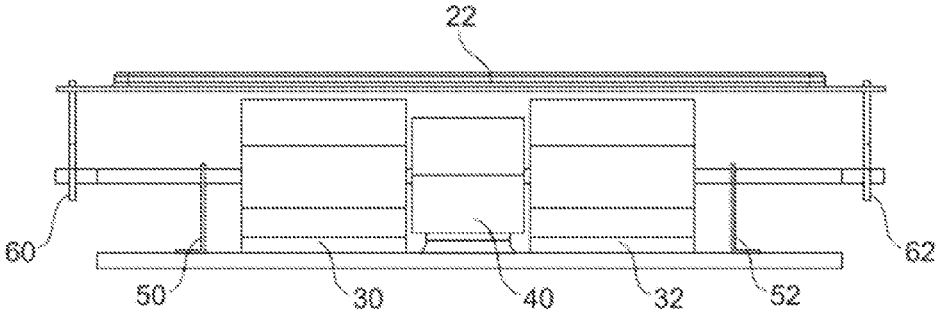
FIG. 4 illustrates a third embodiment.

In FIG. 4, the relative positions of the magnets 30/32 and the support elements 50/52 have been altered. The same overall effect, however, is seen.

Figure 12:
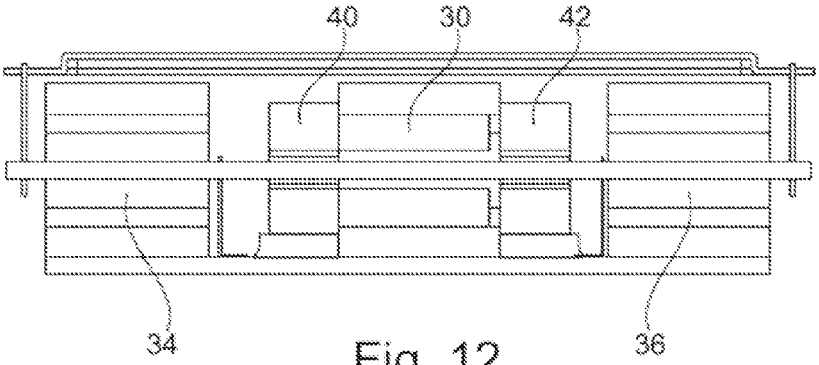
FIG. 12 illustrates a seventh embodiment.
Figure 13:
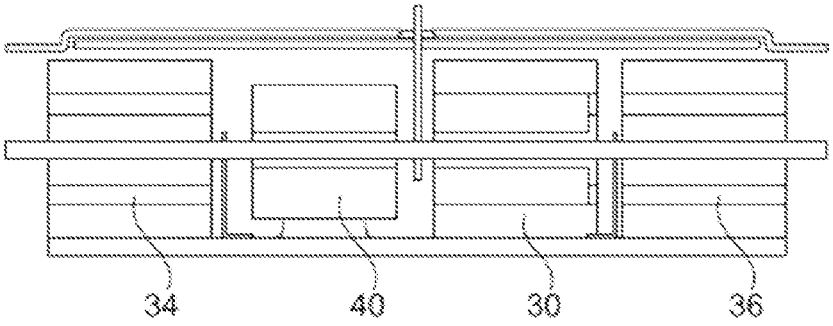
FIG. 13 illustrates an eighth embodiment.

In FIG. 12, another embodiment is seen wherein a single magnet 30 is provided along with two coils 40/42. A single coil 40 would suffice, as is seen in FIG. 13.

In these embodiments, two return path elements 34 and 36 have been provided in order to provide a high permeability flux path from the coil, through the magnet and back. One return path element, i.e. the return path element 36, suffices, as it is positioned so as to return flux flowing in the armature and through the magnet 30 to the coil 40.

The flux return path elements 34/36 may be elements of a high permeability positioned so as to guide flux from the armature to the base or any other element taking part in the flux path. The flux return path elements 34/36 preferably allow the armature to move towards/away from the base without contacting the flux return path elements 34/36 while preferably maintaining as small a distance to the armature in order to guide as much flux as possible.

Figure 5:
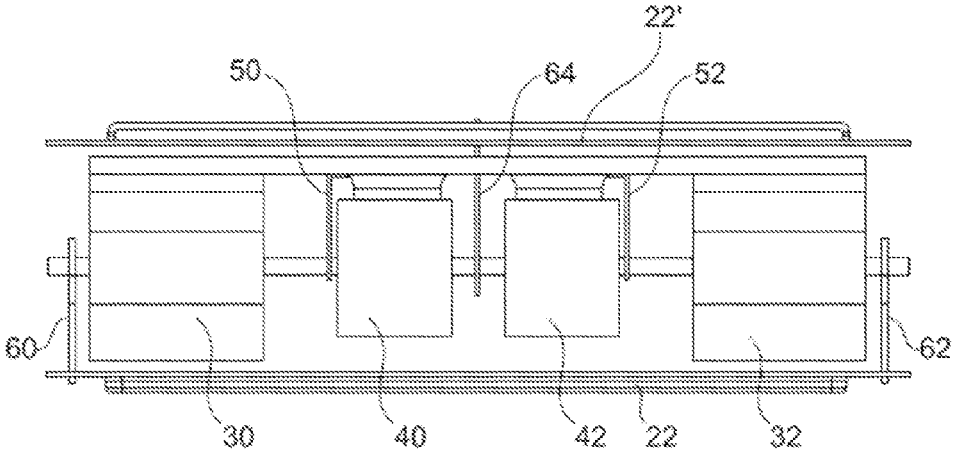
FIG. 5 illustrates a dual diaphragm embodiment.

If the return path elements 34/36 are left out, the support elements 50/52 may aid in the flux return path, or constitute the return path In FIG. 5, a dual diaphragm set-up is seen wherein, in addition to the diaphragm 22, an additional diaphragm 22' has been provided being driven by a third element 64 now provided at the centre portion 24*c* of the armature. It is seen that when the lower diaphragm 22 is moved downwardly, the upper diaphragm 22' is moved upwardly.

Figure 6:
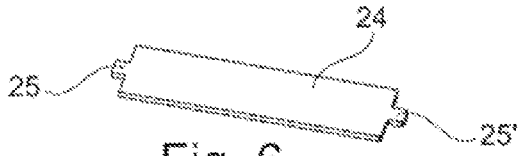
FIG. 6 illustrates an armature suitable for use in the apparatus of the invention.

In FIG. 6, an armature type is seen which is oblong and at its ends has parts 25/25' to which the first and second elements 60/62 may be fixed, such as by welding, gluing, soldering or the like.

Figure 7:
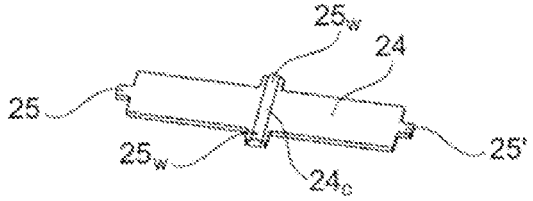
FIG. 7 illustrates another armature suitable for use in the apparatus of the invention.

In FIG. 7, an alternative armature design is illustrated which again has the outer parts 25/25' but now also has wings 25*w*, to which one or two centrally positioned third elements 64 (see FIG. 5) may be fastened. In addition, it is seen that the armature in FIG. 7 has an indentation at the central portion 24*c*. This indentation may act as a hinge portion if desired.

Figure 8:
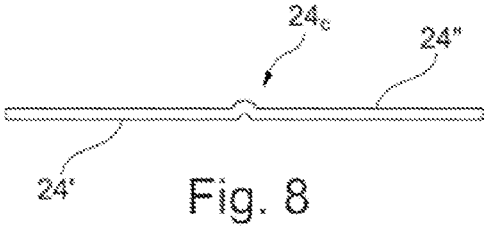
FIG. 8 illustrates a further armature suitable for use in the apparatus of the invention.

In FIG. 8, yet another alternative of an armature may be seen which also has a central portion configured to act as a hinge portion.

The armature of FIG. 8 is a stack construction which makes the parts 24/24" stiffer. The stacked elements of the armature may be combined by gluing, welding, soldering or the like.

Figure 9:
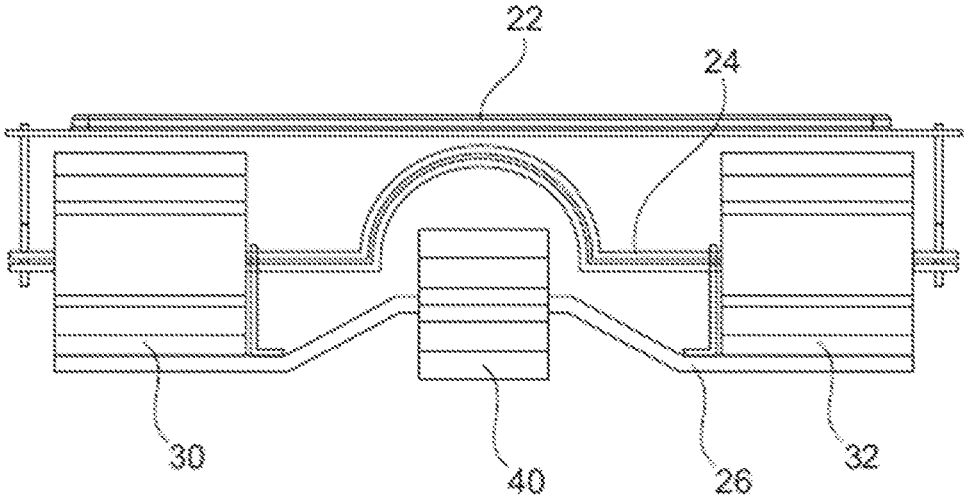
FIG. 9 illustrates a fourth embodiment.

FIG. 9 illustrates yet another embodiment of the most relevant parts of a loudspeaker. In this embodiment, the magnetic circuit has been altered in that the base 26 now extends through the coil 40, whereby the armature 24 only extends through the magnets 30/32.

The armature 24 has been bent so as to make space for the coil 40, so that the overall height of the assembly is reduced.

The magnetic circuit again comprises the armature, the base and the magnets and again, the electro-magnetic field is generated by the coil.

Naturally, the base, in FIG. 9, could be replaced by another element configured to guide the electro-magnetic field from the coil to the magnets.

Figure 10:
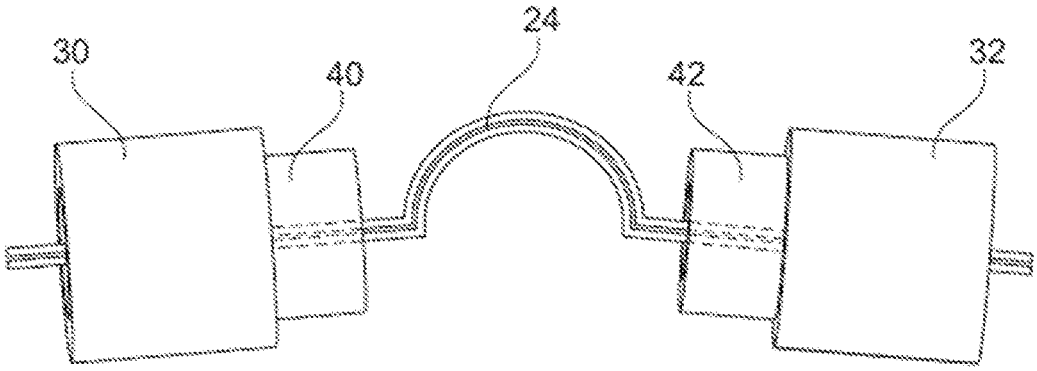
FIG. 10 illustrates a fifth embodiment.

In FIG. 10, the armature of FIG. 9 is illustrated in a permanently bent shape, which is suitable for positioning in e.g. the BTE part of a hearing aid.

Naturally, the first and second elements 60/62 may be provided at the extreme ends of the armature 24, but it may be found easier to provide a single, third, element at the centre (top portion) of the armature 24.

In general, it is noted that when the armature is bending, the interface between the armature and the support elements 50/52 may be stressed. This interface may be a fixed interface, where the armature is welded/soldered/glued to the support elements 50/52.

It is noted that the support elements 50/52 may themselves be bendable, so that they (in FIG. 1) bend slightly outwardly, when the armature ends are forced downwardly as in configuration of FIG. 10.

In addition, the armature preferably, a least the outer parts 24'/24" thereof as well as the parts at the support elements 50/52, is stiff, so that the force exerted to the outer parts 24'/24" is transferred also to the central part **24*c*** in order to obtain the below advantage in a lower vibration of the loudspeaker.

Then, the central part **24*c*** may be made more bendable than other parts of the armature. A well-defined hinge portion or bending portion may be defined, such as by providing a part which is softer, more bendable, more resilient or the like. A simple manner of providing a hinge portion is to provide a portion with a thinner cross section, at least perpendicular to the direction of force exerting (in the plane of the figure). In other embodiments, the armature material may be altered, adapted, replaced, softened or the like in order to be more resilient at the desired position.

In addition or alternatively, the interface between the support elements 50/52 and the armature may be resilient, such as by using a glue type which when after curing still has a resiliency.

In the above embodiments, it has been sought that the magnets and coil(s) is/are symmetrically positioned around a centre portion of the armature. The same is the situation for the position of the support elements 50/52 and the first/second/third elements 60/62/64, as this makes the design easier.

Naturally, such symmetry is not a requirement. The skilled person will know that displacing the first element 60 toward the centre of the armature 24 will make the overall movement (at a certain bending of the armature) lower but will increase the force/torque applied. Also, the positions of the magnets and the coil(s) will determine the electromagnetic field at the magnets and, together with the direction of magnetization and the strength of the magnets and, thus, the force exerted on to the armature. Then, the positions of the support elements 50/52 and the stiffness of the armature will determine the overall bending of the armature, where also the mass, resiliency etc. of the diaphragm could be taken into account. Thus, finally, the displacement of the diaphragm and thus the sound pressure provided may be determined.

Thus, the skilled person will be able to derive also non-symmetric set-ups and determine (if tests are not sufficient) the output obtained.

In addition to the above determination of the functioning of non-symmetric set-ups, the dynamics determined may also be used for calculating the vibration of loudspeakers of this type. When, in FIG. 1, the magnets pull the ends of the armature downwardly, the diaphragm, the first/second elements 60/62 and the ends 24'/24" are moved downwardly, while the part **24*c* is moved upwardly. The resulting vibration may be determined, and it is seen that this depends on e.g. the armature thickness etc. but also on the positions of the support elements 50/52**.

In this respect, it may be desired to provide a heavier central portion **24*c* of the armature, such as by making it longer, thicker or the like, to counter the weight of the outer ends 24'/24" and the diaphragm moving in the other direction. In a first approximation, it may be desired to ensure that the outer parts 24' and 24" weigh the same as the central part 24*c*, as they move in opposite directions. It may also be desired to add to the weight of the parts 24/24" the weight of the diaphragm 22, as it moves with the parts 24/24"**.

In that respect, it may be desired to fasten the coil 40 to the central portion **24*c* and thus have the coil movable in relation to the base 26. This will increase the mass of the central portion, which may be desired, if the portion 24*c*** is quite short.

Naturally, the other set-ups may require that the diaphragm mass is added to the mass of the part **24*c***, if the diaphragm is driven by that part.

In relation to FIG. 13, the use of flux return paths 34/36 may be utilized also, if the flux return paths 34/36 are fixed to the armature to again add mass to predetermined parts of the armature.

Figure 11:
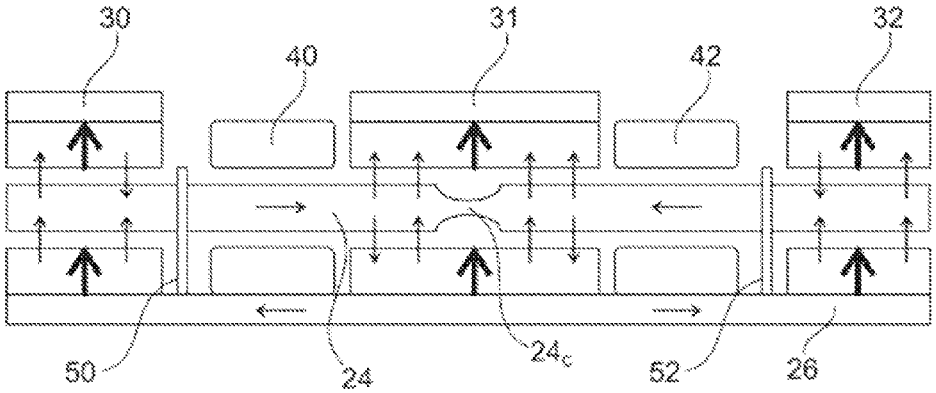
FIG. 11 illustrates flux return paths in a sixth embodiment.

In FIG. 11, the magnetic circuit is illustrated in another embodiment of a loudspeaker according to the invention. In this embodiment, a third magnet 31 is positioned at the central portion **24*c* of the armature, and where two coils 40/42** are used.

It is seen that the coils 40/42 are driven in opposite directions so that the electromagnetic fields generated in the armature are directed oppositely to each other. The direction of magnetization of the magnets is the same.

In this respect, it is seen that two magnetic circuits are formed: one magnetic circuit is fed by the coil 40 and comprises magnet 30 and the left parts of armature, base and magnet 31. The other magnetic circuit comprises the coil 42, magnet 32 and the right parts of armature, base and magnet 31. No large part of any magnetic field is transported between the left and right sides of the armature.

This embodiment has a number of advantages. One advantage is that, as mentioned, no or very little magnetic flux is guided across the centre **24*c* of the armature 24**, whereby the magnetic properties and the mechanical properties of this part of the armature may be de-coupled. There, thus, is no problem in using a reduced cross section to provide a well-defined bending or flexing position.

Another advantage is that all magnets 30/31/32 are magnetized in the same direction, which benefits production of the loudspeaker.

Figure 14:
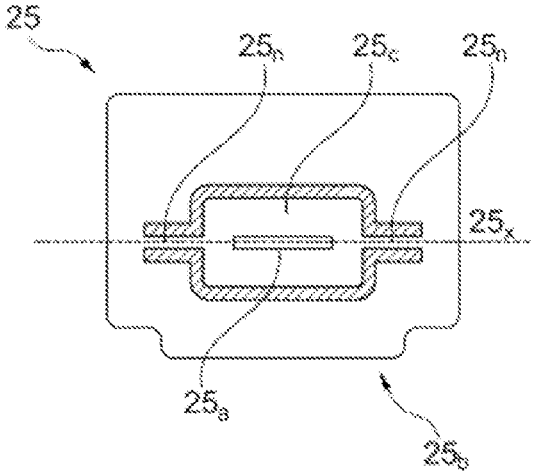
FIG. 14 illustrates a preferred supporting element for use in the loudspeaker of the invention.

FIG. 14 illustrates a particularly preferred type of supporting element 25 which is made of a layer of a material, such as a metal, having a part 25*b* attachable to the housing 20. Alternatively, the element 25 may be fixed to a magnet if desired.

The element 25, which may be made by blank cutting, stamping/punching, laser cutting or the like, has a central portion 25*c* having an opening 25*a* for the armature and connected to the remainder of the element 25 by two narrow parts 25*n* defining an axis 25*x* around which the central portion 25*c* may rotate while the remainder of the element 25 is fixed to the housing.

Figure 15:
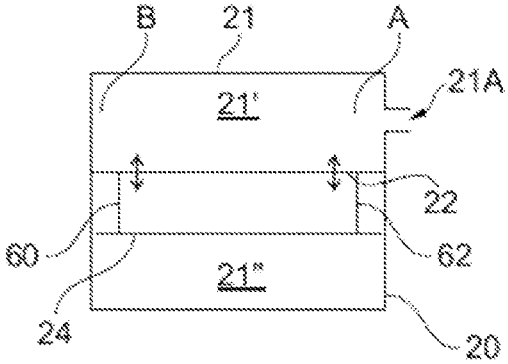
FIG. 15 illustrates a loudspeaker comprising a housing.

FIG. 15 illustrates an embodiment wherein a motor assembly as that illustrated in e.g. FIGS. 1-13 is used having a diaphragm 22, an armature 24, drive pins or elements 60/62. The coil(s), magnet(s) and the base have been left out in order to not complicate the drawing.

It is seen that the diaphragm 22 divides the interior of a housing 21 into two chambers 21' and 21" and that a sound opening or output 21A is provided from the chamber 21'.

When the armature 24 forces the elements 60/62 and thus the diaphragm 22 upwardly, the air pressure in the chamber 21' increases, and air is forced out of the output 21A. During this process, the air pressure in the chamber 21' will be higher in the area B away from the output 21A than in the area A at the output 21A. Thus, a larger force or torque is required in the area B in order to move the diaphragm 22 the same distance, in order to obtain a high sound pressure output.

Thus, the force or torque exerted by the armature 24 to the element 60 is higher than that exerted to the element 62. This may be obtained as described above by providing a stronger magnet, a larger flux in the armature from the coil and/or by positioning the element 60, on the armature, at a position where a smaller deflection takes place.

An alternative, of course, is to provide two different motor assemblies or elements, one for driving each element 60 and 62, where the motor assemblies may be of any desired type, such as moving armature, moving coil or the like, where the assembly driving the element 60 may be stronger than the other one (stronger magnet, different coil or the like) and/or may be fed a higher current in order to provide the larger force/torque.

Figure 16:
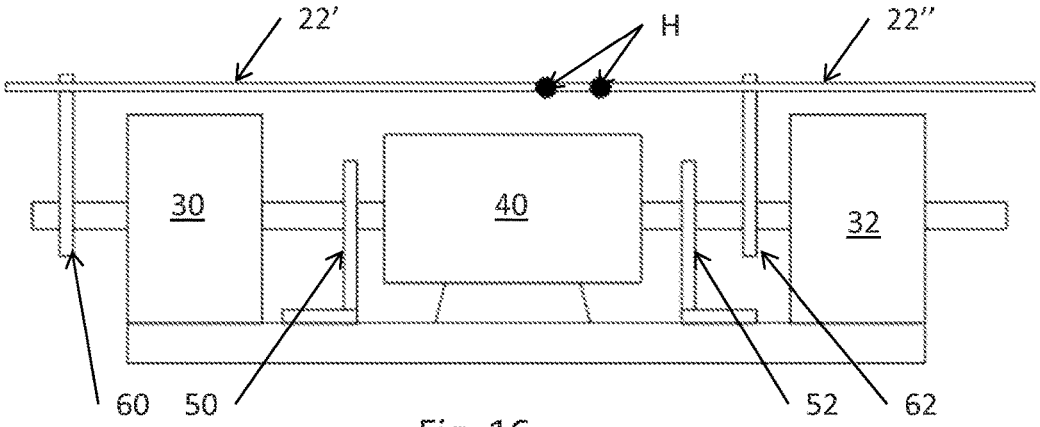
FIGS. 16 and 17 illustrate embodiments with hinged, dual diaphragms.

In FIG. 16, an embodiment largely as that of FIG. 1 is seen. Some of the reference numerals have been left out for the sake of clarity, and the largest differences are the positions of the first and second elements 60/62 and the fact that the diaphragm is divided into two diaphragms 22 and 22' separated by two hinge portions H, providing bending hinges along axes perpendicular to the plane of the drawing. Naturally, a single hinge H may be used, but the advantage of providing two hinges is that the portion of the diaphragm between the hinges H may be stationary, such as fixed to a portion of the housing.

It is seen that the first and second elements 60/62 have different displacements or drive ratios and thus will drive the diaphragms 22/22' differently.

Clearly, different positions of the hinge portion(s) H and the first/second elements 60/62 in relation to the armature 24 will drive the diaphragms 22'/22" differently, where the difference may be both the amplitude of the vibration/displacement and the torque or force with this driving is performed. Thus, different amounts of air may be displaced with the same overall frequency contents, as these are defined by the movement or vibration of the armature 24.

The upper side (in the drawing) of the diaphragms 22'/22" may define or take part in the defining of the same chamber of the loudspeaker, or two different chambers may be defined where the diaphragm 22' takes part in the delimitation of only one chamber and the diaphragm 22" in the part of only the other chamber. The chambers may be separated by a separating wall engaging the diaphragm portion between the hinges H.

Figure 17:
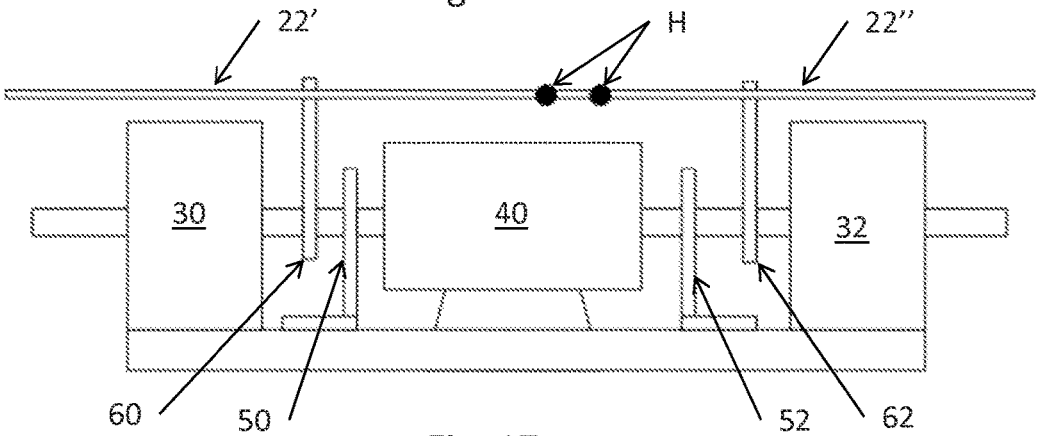

In FIG. 17, a corresponding set-up is illustrated where the first element 60 has been shifted into a position similar to that (mirrored) of the second element 62, but as the hinge portions H are not positioned directly around the centre of the set-up, the two diaphragms 22'/22" are still driven differently.

Figure 18:
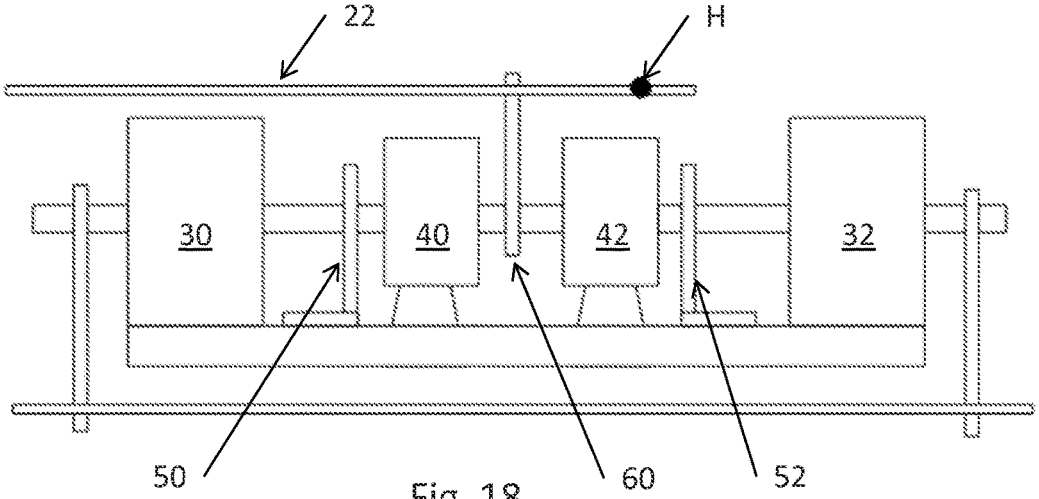
FIG. 18 illustrates an embodiment with a hinged, single diaphragm.

In FIG. 18, a single diaphragm 22 is illustrated driven by a first element 60 but again having a hinge portion H. Again, it is seen that the position of the hinge portion H and the first element 60 may define the amplitude and force/torque applied to the diaphragm 22.

Figure 19:
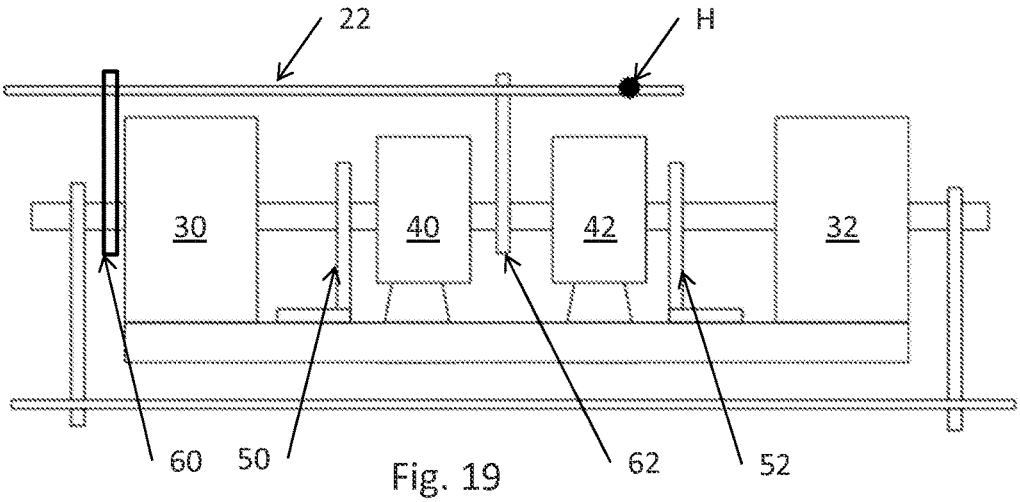
FIG. 19 illustrates an embodiment with a hinged diaphragm divided along the direction of the armature.
Figure 20:
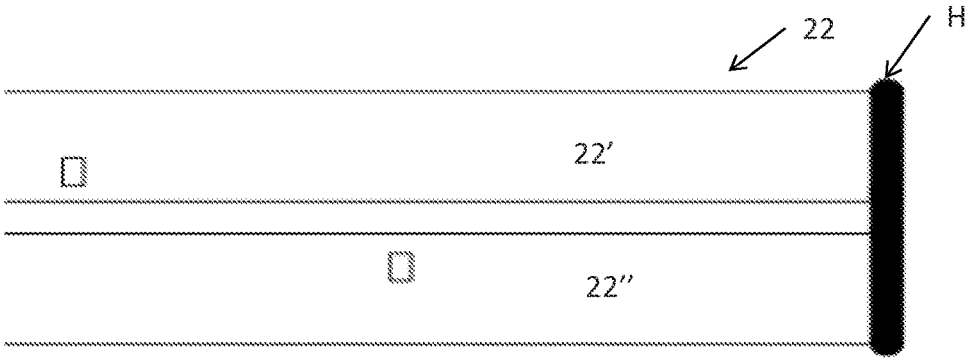
FIG. 20 illustrates a diaphragm for use in the embodiment of FIG. 19.

In FIG. 19, an embodiment is seen with, again, a first and a second element 60/62 and a diaphragm 22 with a hinge element H. The diaphragm 22 is illustrated in FIG. 20 and has been divided up along the longitudinal direction of the armature 24. The hinge portion H is provided, as in the embodiments of FIGS. 16-18, perpendicular thereto. Thus, the two resulting diaphragms 22' and 22" may be moved independently out of the plane of FIG. 20 and up/down in FIG. 19.

Between the diaphragms 22'/22", a resilient sealing material may be provided so as to prevent air or at least sound from moving from the lower side (in FIG. 19) of the diaphragms to the upper side thereof.

It is seen that the positions of the hinge portion H and the first/second elements 60/62 again may provide different movements/vibrations of the two diaphragms 22'/22". Also, as is described in relation to FIG. 16, the two diaphragms 22'/22" may (above them in FIG. 19) delimit the same chamber or they may take part in the delimiting of different chambers, if a sound barrier is provided between the diaphragms 22'/22" so as to divide the inner portion of a housing, in which the drive mechanism of FIG. 19 is positioned, into at least three chambers: one chamber above the diaphragm 22', one chamber above the diaphragm 22", and one or more chambers below the diaphragms 22'/22".

Clearly, the above embodiments are only examples of the inventions claimed. As mentioned, the symmetry desired is by no means a requirement.

Also, more than two support elements may be used. Any number of support elements may be used, as the main operation is that when the armature on one side of the support element moves toward the diaphragm, it will move away therefrom on the other side. Providing three supporting elements, for example, this pattern will simply be repeated. Thus, the armature will move toward the diaphragm at more positions and more parts of the armature will move away from the diaphragm. Then, more positions are available for positioning magnets and coils, if this is desired. In this example, it may be preferred that the support elements engage the armature at equidistant positions. Alternatively, the bending properties of the armature may be varied in order to support a deformation with constant or invariate movement at the positions of the support elements.

The invention claimed is:

1. A loudspeaker comprising:

a first magnet configured to output a first magnetic field in a first magnet gap, an elongate armature extending through the first magnet gap, a first coil configured to generate a magnetic flux in the armature, a first diaphragm, a first element configured to transfer force and/or movement from the armature to the first diaphragm, a base and a first and a second support elements, the first support element connecting the armature to the base at a first longitudinal position at a first side of a predetermined portion along the length of the armature, and the second support element connecting the armature to the base at a second longitudinal position at a second, opposite side of the predetermined portion the magnetic flux bending the armature at the predetermined portion, wherein force and/or movement is transferred, via the first element, from the armature to the first diaphragm.

2. The loudspeaker according to claim 1, wherein at least one of the first and second support elements are configured to rotatingly fix the armature to the base at the first and second longitudinal positions.

3. The loudspeaker according to claim 1, wherein the predetermined portion is configured to be moved in a direction toward or away from the base.

4. The loudspeaker according to claim 1, wherein the armature is configured to be movable in a direction toward or away from the base within the first magnet gap.

5. The loudspeaker according to claim 1, wherein the armature extends within the first coil and is configured to be movable in a direction toward or away from the base within the first coil.

6. The loudspeaker according to claim 1, wherein the armature extends within the first coil and is fixed to the first coil.

7. The loudspeaker according to claim 1, the loudspeaker comprising an additional element configured to transfer force and/or movement from the armature to the first diaphragm, the first and additional elements both being positioned either between the first and second support elements or outside the first and second support elements.

8. The loudspeaker according to claim 1, the loudspeaker further comprising a second magnet configured to output a second magnetic field in a second magnet gap, the armature extending through the second magnet gap.

9. The loudspeaker according to claim 1, the loudspeaker comprising an additional diaphragm and a second element configured to transfer force and/or movement from the armature to the second diaphragm.

10. The loudspeaker according to claim 1, wherein the armature has two extreme end portions and wherein a mass of a part of the armature between the first and second positions is no more than 10% higher or lower than a mass of parts of the armature between the end portions and the first and second positions, respectively.

11. The loudspeaker comprising a housing comprising a chamber, a sound output, a diaphragm forming part of an inner surface of the chamber and a motor assembly comprising an armature, a coil, and a magnet as well as at least a first and a second transfer element configured to transfer movement or force from the armature to the diaphragm, where the first transfer element is positioned closer to the output than the second transfer element, the motor assembly being configured to exert a larger displacement/force/torque on the diaphragm via the second transfer element than the first transfer element.

12. The loudspeaker according to claim 1, the loudspeaker comprising an additional element, the first and additional elements being positioned either between the first and second support elements or outside the first and second support elements and wherein the transfer step comprises also the additional element transferring force and/or movement from the armature to the first diaphragm.

13. The loudspeaker according to claim 1, the loudspeaker comprising an additional diaphragm and a second element, and wherein the transfer step comprises the second element transferring force and/or movement from the armature to the second diaphragm.

14. The loudspeaker according to claim 1, wherein the armature is configured to be movable in opposite directions on opposite sides of the first and second longitudinal positions.

15. A loudspeaker comprising:

a first magnet configured to output a first magnetic field in a first magnet gap, an elongate armature extending through the first magnet gap, a first coil configured to generate a magnetic flux in the armature, a first diaphragm, a first element configured to transfer force and/or movement from the armature to the first diaphragm, a base, and a first and a second support elements, the first support element connecting the armature to the base at a first longitudinal position at a first side of a predetermined portion along the length of the armature, and the second support element connecting the armature to the base at a second longitudinal position at a second, opposite side of the predetermined portion, wherein the armature has two extreme end portions and wherein a mass of a part of the armature between the first and second positions is no more than 10% higher or lower than a mass of parts of the armature between the end portions and the first and second positions, respectively.

* * * * *